United States Patent [19]

Armbruster

[11] Patent Number: 5,007,319

[45] Date of Patent: Apr. 16, 1991

[54] PLASTIC WRAP DISPENSER

[76] Inventor: Joseph M. Armbruster, 2700 NE. 47th St., Lighthouse Point, Fla. 33064

[21] Appl. No.: 82,482

[22] Filed: Aug. 7, 1987

[51] Int. Cl.[5] ..... B26D 1/18; B65H 75/32

[52] U.S. Cl. ..... 83/488; 83/614; 83/649

[58] Field of Search ..... 83/487, 488, 205, 649, 83/650, 455, 456, 614, 147

[56] References Cited

U.S. PATENT DOCUMENTS

| | | | |
|---|---|---|---|
| 2,312,456 | 3/1943 | Walters et al. | 83/147 |
| 3,748,939 | 7/1973 | Feinstein et al. | 83/370 |
| 3,848,501 | 11/1974 | Kuts | 83/471.3 |
| 3,919,905 | 11/1975 | Hoffman | 83/205 |
| 4,754,674 | 7/1988 | Perlman | 83/422 |

*Primary Examiner*—Hien H. Phan
*Assistant Examiner*—Eugenia A. Jones
*Attorney, Agent, or Firm*—Fleit, Jacobson, Cohn, Price, Holman & Stern

[57] ABSTRACT

A dispenser for plastic wrap material including a housing for storing a spirally wound supply roll of plastic wrap and a mechanism for cutting a quantity of plastic wrap from the supply roll with the dispenser including a discharge slot for the plastic wrap material, a powered rotary cutter mounted on a carriage supported and guided for movement transversely of the path of the plastic wrap material and a structure which enables the plastic wrap material to be pulled off of the supply roll out through a discharge slot with the structure including a door which precludes accidental contact with the rotary cutter thereby providing an efficient and safely operated plastic wrap dispenser.

6 Claims, 3 Drawing Sheets

PLASTIC WRAP DISPENSER

BACKGROUND OF THE INVENTION

1. Field of the Invention

The present invention generally relates to a dispenser for plastic wrap material and more specifically a dispenser including a housing rotatably supporting a spirally wound roll of plastic wrap and a mechanism for cutting a quantity of plastic wrap from the supply roll with the dispenser including a discharge slot for the plastic wrap material, a powered rotary cutter mounted on a carriage supported and guided for movement transversely of the path of the plastic wrap material and a structure which enables the plastic wrap material to be pulled from the supply roll out through the discharge slot with the structure including a door which precludes accidental contact with the rotary cutter thereby providing an efficient and safely operated plastic wrap dispenser.

2. Information Disclosure Statement

Plastic wrap material has many uses in the home and in commercial establishments for closing the open upper end of dishes, wrapping sandwiches, food products and the like. However, plastic wrap is difficult to use and introduces many problems during repetitive use. It is well-known that the plastic wrap material is difficult to cut in a straight manner and will tear off in an uneven manner and clings to itself thereby causing waste and frustration. Conventional plastic wrap dispensers are cardboard containers with a discharge area having a serrated metal blade along one edge of the discharge area against which the plastic wrap is pulled so that the serrated metal cutting blade will cut the plastic wrap. This is time consuming and also is difficult to perform effectively. While efforts have been made to dispense various products supplied in a spiral roll, there has been no practical device which dispense plastic wrap material in an efficient manner.

SUMMARY OF THE INVENTION

An object of the present invention is to provide a plastic wrap dispenser including a housing provided with an openable end and a movable mandrel having a tapered rotatable cone thereon in opposed relation to a stationarily mounted tapered rotatable cone on the housing to enable a roll of plastic wrap material to be inserted in the housing with the housing also including a discharge slot through which the free end of the plastic wrap material is positioned for enabling the plastic wrap material to be unwound from the supply roll and through the slot so that a desired length thereof may be cut from the supply roll.

Another object of the invention is to provde a plastic wrap dispenser in accordance with the preceding object in which the plastic wrap material after it passes through a discharge slot is positioned over a slot in the housing in which a powered rotary cutter blade moves transversely of the plastic wrap material for cutting the plastic wrap material at a desired length.

A further object of the invention is to provide a plastic wrap dispenser in accordance with the preceding objects in which the powered rotary cutter blade is mounted on a carriage suspended from overhead rails carried by the housing with a powered transport mechanism moving the rotary cutter blade from an initial position at one side edge of the plastic wrap material to a position past the other edge thereof for cutting the plastic wrap material and then returning the rotary cutter blade to an initial stored position.

Still another object of the invention is to provde a plastic wrap dispenser in which the discharge slot and rotary cutter blade are concealed within a portion of the housing by a vertically reciprocal door that is moved by a power mechanism between open and closed positions so that the cutting operation can be performed only when the access door is in closed position thereby precluding accidental injury due to contact with the rotary cutting blade during its operating cycle.

Yet another object of the invention is to provide a plastic wrap dispenser in accordance with the preceding objects which is simple in construction, effective for maintaining plastic wrap in convenient position to enable a quantity of plastic wrap to be pulled outwardly of the machine from the supply roll with the closure door then providing a safety factor during the cutting operation so that a desired quantity of plastic wrap may be effectively and safely obtained.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
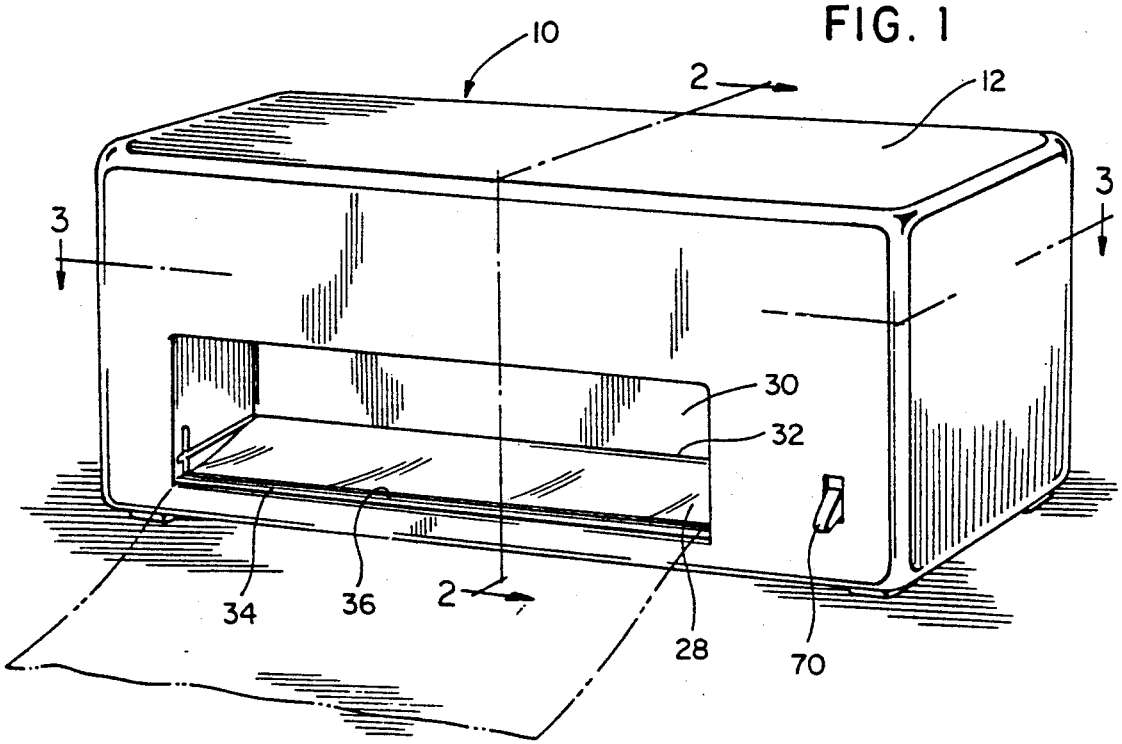
FIG. 1 is a perspective view of the plastic wrap dispenser of the present invention.
Figure 6:
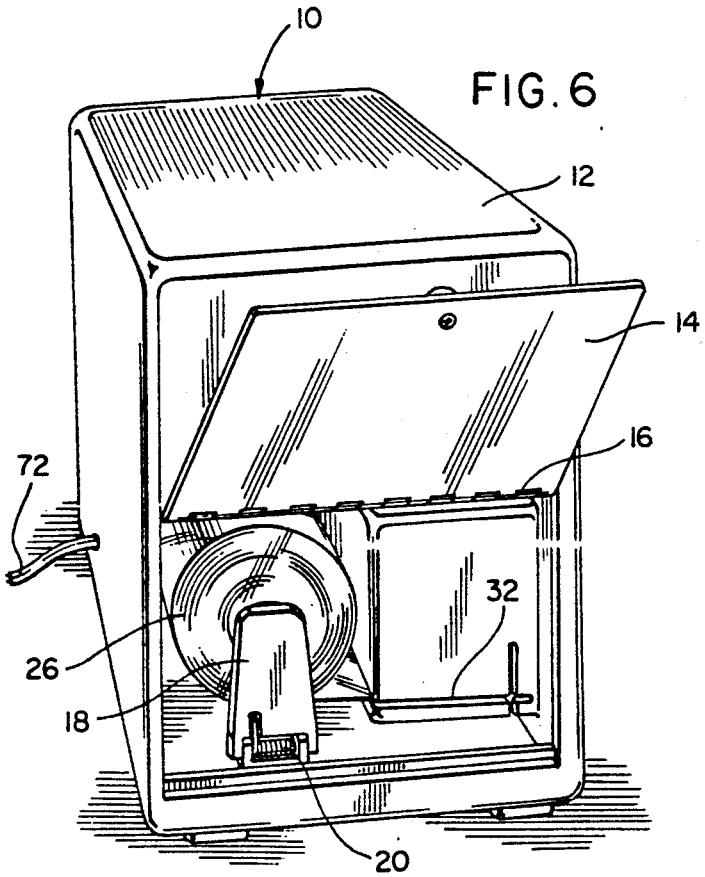
FIG. 6 is an end perspective view thereof illustrating the openable door and pivotal mandrel enabling the plastic wrap supply roll to be positioned in the dispenser.
Figure 5:
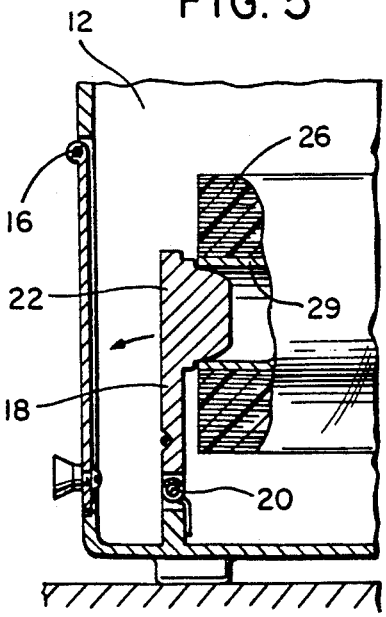
FIG. 5 is a detailed fragmental view illustrating further structural details of the invention.

Referring now specifically to the drawings, the plastic wrap dispenser of the present invention is generally designated by the reference numeral 10 and includes a hollow housing 12 which may be elongated and generally rectangular or square in cross-sectional configuration and provided with supporting feet or other supporting structures to enable it to be supported on a supporting surface such as a countertop or supported from a wall surface or the like in any convenient position so that an operator can have access to the housing. As illustrated, the housing includes a pivotal partial end wall 14 supported by a suitable hinge 16 that opens to provide access to a pivotal mandral 18 which has a spring hinge 20 and a tapered cone 22 in opposed relation to a stationary cone 24 to supportingly and rotatably receive a supply roll 26 of plastic wrap material 28 in which the supply roll includes a cardboard center tube 29 engaged with the mandrels thereby rotatably supporting the supply roll 26 in the housing.

Figure 2:
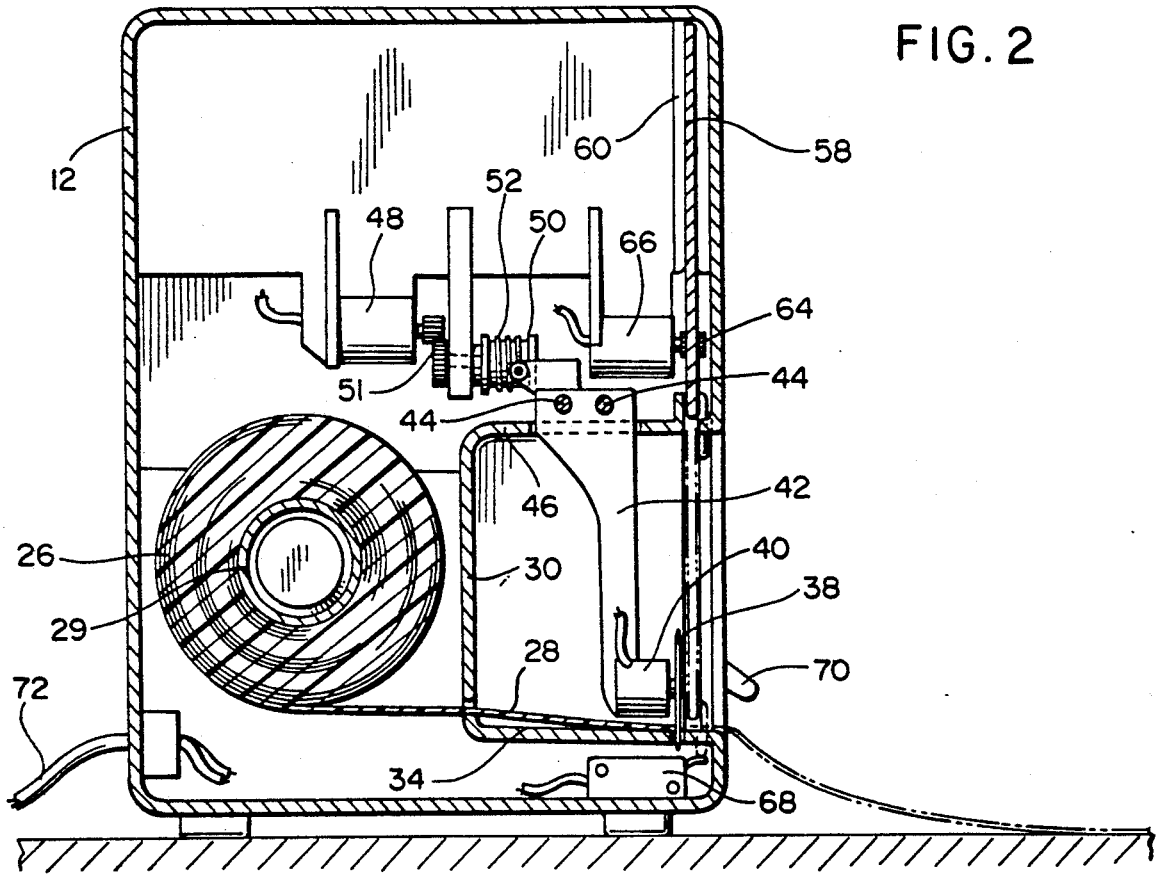
FIG. 2 is a transverse, sectional view of the plastic wrap dispenser taken along section line 2—2 on FIG. 1 illustrating the specific structural details of the components and their association.
Figure 4:
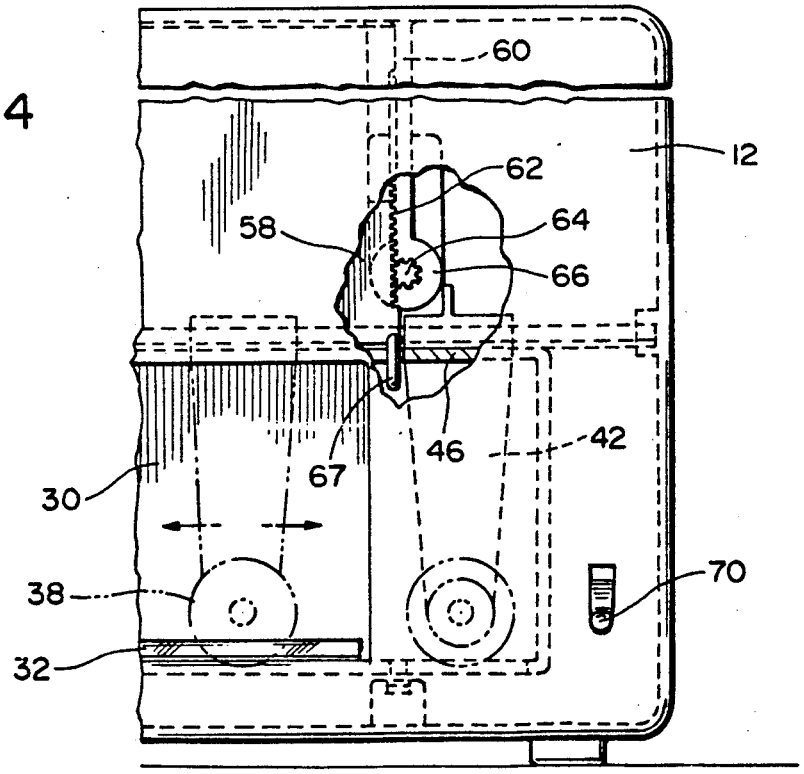
FIG. 4 is a detailed view of the door mechanism.

As illustrated in FIG. 2, the housing 12 includes a vertical partition wall 30 having a discharge slot 32 at the lower end thereof through which the plastic wrap material 26 passes from the supply spool or roll 26. The slot 32 is open at the end thereof adjacent the pivotal access door 14 so that the plastic wrap material 28 may be inserted into the slot 32 from the end thereof when positioning the supply roll 26 on the mandrel cone 24. This orients the end of the plastic wrap material on a horizontal supporting surface 34 which enables the two edges of the plastic wrap material 28 to be grasped and the plastic wrap material pulled outwardly thereby unrolling a desired quantity or length of plastic wrap material 28 from the supply roll 26. The pull-out of the plastic wrap material eliminates the possibility of the plastic wrap material following the supply roll 26 and also eliminates any possibility of the plastic wrap material following or adhering to feed rollers, guide rollers and the like.

Figure 3:
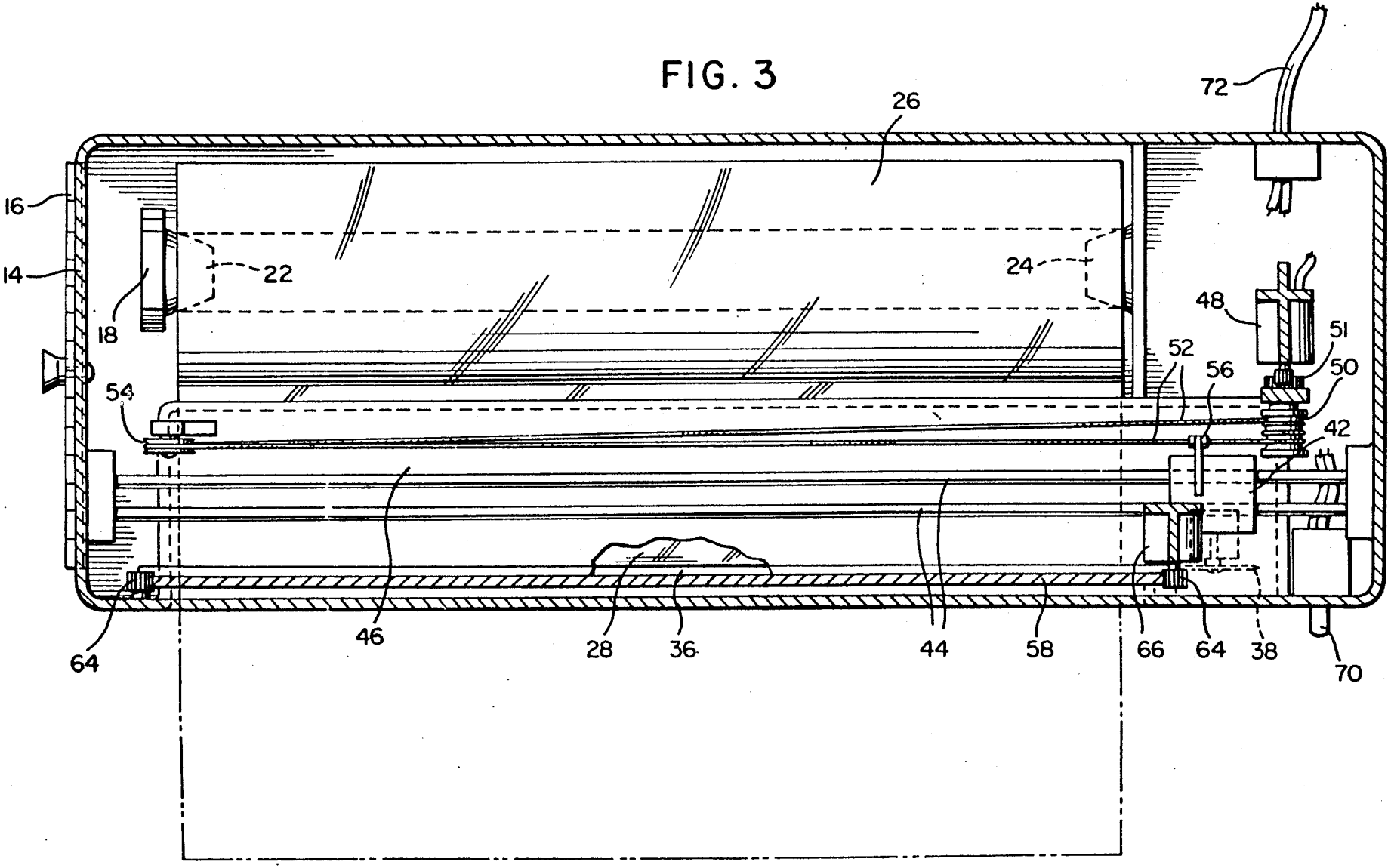
FIG. 3 is a longitudinal, plan sectional view of the dispenser taken along section line 3—3 on FIG. 1 illustrating further structural details and relationships of the components.

The plastic wrap material 28 is pulled across a slot or groove 36 in the supporting shelf or surface 34 outwardly of the slot 32 with the groove or slot 36 adapted to receive the lower periphery of a circular rotary cutter blade 38 supported on the output shaft of an electric motor 40 supported from the lower end of a vertically disposed carriage or bracket 42 which may be generally of C-shaped configuration. The bracket or carriage 42 is movably supported and guided by a pair of parallel guide rails 44 supported from the housing above the recess defined by the vertical partition 30 and a horizontal partition 46 located below the guide rails 44 but having an opening in the top to enable the vertically depending bracket or carriage 42 to move transversely across the plastic wrap material 28 so that the powered rotary cutter blade 38 will cut the plastic wrap material 28 thereby severing the desired length of plastic wrap material and leaving the residual end of the plastic wrap material 28 resting against the supporting surface 34 so that it can be subsequently grasped and pulled outwardly to obtain another quantity of plastic wrap material. The carriage or bracket 42 is moved transversely of the plastic wrap material by a motor 48 having a cable drum 50 driven thereby through a reduction gear assembly 51 and a transport cable 52 which wraps on the drum and over end pulley 54 and connected to carriage 42 at 56 for moving the carriage or bracket from the position illustrated in FIG. 3 where it is laterally outwardly of the recess which receives the free end of the plastic wrap material across the width of the plastic wrap material and then returned to the stored position.

A vertically movable closure door 58 is mounted in a channel shaped guideway 60 at each side of the recess with one edge of the closure door including a rack gear formed thereon as indicated by the numeral 62 which has a pinion gear 64 meshing therewith with the pinion gear being driven by a motor 66 and supported above the guide rails 44 in order to power the door 58 vertically from an open position illustrated in FIG. 2 to a closed position. The lower edge of the door is provided with a pin 67 which extends downwardly through an opening in the horizontal supporting structure 34 into engagement with a switch 68 so that the switch 68 will actuate the cutter motor 40 and transport motor 48 after the door 58 has been fully closed. The door motor 66 may be actuated by a manually operated switch 70 located at the lower corner of the housing so that when a desired quantity of plastic wrap has been pulled through the slot 32, the person using the device may actuate the switch 70 to close the door 58 which in turn actuates the switch 68 for operating the cutter motor 40 and the transport motor 48 to move the rotating cutter blade 38 across the width of the plastic wrap material and back to its initial position at which point the motor 66 will be actuated in reverse direction to open the door and the transport motor 48 and the rotary blade motor 40 will be stopped prior to the door opening thereby avoiding any possibility of injury due to accidental contact with the rotary cutting blade. Electrical energy is supplied to the motors and control switches by a conventional electric cord 72.

As an alternative to the manual operating switch, a timer delay may be provided so that once the operator pulls the plastic wrap out to the desired length, a timer mechanism that incorporates an approximate two-second delay after the material has ceased to be pulled from the supply roll will automatically close the door and actuate the cutting procedure in the same manner as if the manual switch had been actuated thereby eliminating any external switch mechanism.

Regardless of how the transport motor and cutting motor are actuated, they cannot be actuated until the protective cover door is in closed position. Thus, when the cover door is actuated, either automatically or with a manual switch, it travels downward under power by its drive motor through the rack and pinion drive mechanism with the door including the actuating pin that engages the recessed switch which in turn activates a control arrangement that automatically starts the cutter motor for the cutter blade and the transport motor for moving the carriage. After the cut has been made, the cutter motor is automatically turned off and the transport motor returns the cutter and its carriage to its stored position. The cover door then is automatically raised and the plastic wrap's leading edge is intact and ready for use at the cutting wheel slot as illustrated in FIG. 1.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A dispenser for sheet film material comprising a housing, means within said housing for rotatably supporting a supply roll of film material, said housing including a discharge slot receiving the film material therethrough, said housing including a supporting surface extending horizontally outwardly from the slot and forming the sole support for the free end of the film material to enable the free end to be grasped and manually pulled to unwind a desired quantity of film material from the supply roll, powered means located outwardly of and spaced from the discharge slot for severing the film material with the free end of the film material being released from grasp and resting on the supporting surface before and after being cut, said means for severing the film material including a circular cutter blade rotatably supported and having its rotational axis disposed above the supporting surface, a motor driving said blade, a supporting carriage for said motor and blade, means guiding movement of the carriage, means moving the carriage and the blade and motor transversely of the film material for cutting the film material, said supporting surface including a groove extending parallel to the discharge slot for receiving a peripheral portion of the cutter blade to assure that the film material is cut by the cutter blade, and a closure door concealing the cutter blade, discharge slot, supporting surface and groove receiving the periphery of the cutter blade, said door being mounted for movement between open and closed positions.

2. The dispenser for sheer film material as defined in claim 1 wherein said door includes a rack gear along one edge thereof, a motor and pinion gear mounted on the housing with the pinion gear meshing with the rack gear whereby the door is powered between open position and closed position with the door, when moved to a closed position, actuating the motor for the cutter blade and causing the cutter blade and motor carriage to move transversely across the film material and back to an original position.

3. The plastic wrap dispenser for sheer film material as defined in claim 2 wherein said means to move the carriage includes a motor and drive connection with the carriage to reciprocate the carriage across the film material.

4. The dispenser for sheet film material as defined in claim 3 wherein said supporting surface is a generally horizontal surface extending laterally from the lower edge portion of said discharge slot, said discharge slot being located in inwardly spaced relation to the closure door to enable access to the free end of the film material when the door is opened after completion of a cutting cycle.

5. A dispenser for plastic film in a supply roll comprising a housing, means within said housing for rotatably supporting a supply roll of plastic film, said housing including a discharge slot receiving the plastic film therethrough, said housing including a generally horizontal supporting surface extending outwardly at the lower edge of the slot for supporting the free end of the plastic film to enable the free end to be grasped and manually pulled to unwind a desired quantity of plastic film from the supply roll, powered means located outwardly of and spaced from the discharge slot for cutting the plastic film with the free end of the plastic film resting on the supporting surface after being cut, said means for cutting the plastic film including a circular cutter blade, a motor driving said blade, a supporting carriage for said motor and blade, means guiding movement of the carriage, means moving the carriage and the blade and motor transversely of the plastic film for cutting the plastic film, said supporting surface including a groove extending parallel to and outwardly of the discharge slot for receiving a peripheral portion of the cutter blade to assure that the plastic film is cut by the cutter blade, said discharge slot, supporting surface, cutter blade, blade motor and carriage being located in a recess in said housing, a vertically movable door forming a closure for the recess and concealing the slot, supporting surface, cutter blade, blade motor and carriage when closed, and power means moving said door between open and closed positions, said door including means to actuate the cutter blade motor and means moving the carriage when the door is moved from an open position to a closed position.

6. A dispenser for a web of sheet material mounted on a supply roll for unwinding therefrom, said dispenser comprising means rotatably supporting a supply roll of material for rotation of the roll when the free end of the material is grasped and pulled tangentially in relation to the supply roll, a stationary discharge slot formed by spaced stationary edges of wall portions for closely receiving the material therethrough as it is unwound from the supply roll, a generally horizontal, laterally extending supporting surface extending outwardly from and forming a continuation of the stationary lower edge of the discharge slot and forming the sole support for the material outwardly of the discharge slot, said supporting surface including a downwardly extending groove therein in spaced parallel relation to the discharge slot, a cutter blade disposed above the recess, a carriage for the cutter blade to support the blade for transverse reciprocation in relation to the groove with a sharpened portion of the blade extending into the groove for cutting the material positioned over the groove, means reciprocating the carriage and blade in relation to the supporting surface and groove, a protective closure member overlying and concealing the groove, carriage and blade, said closure member being movable between a closed position to cover the groove, blade and carriage and an open position to reveal the supporting surface and groove to enable the free end of the material to be grasped and pulled outwardly to a desired length beyond the groove, and means interconnecting the closure member and said means reciprocating the carriage to enable reciprocation of the carriage only when the closure member is in closed position to prevent accidental contact with the carriage and blade during reciprocation thereby providing a safely operated dispenser in which the cutting components thereof are safely enclosed during reciprocation in relation to the material being cut.

* * * * *